United States Patent [19]

Suzuki et al.

[11] Patent Number: 4,502,780

[45] Date of Patent: Mar. 5, 1985

[54] PHOTOCONDUCTOR CLEANING APPARATUS

[75] Inventors: Kohji Suzuki, Yokohama; Hideo Yoo; Yoshio Takamiya, both of Tokyo, all of Japan

[73] Assignee: Ricoh Company, Ltd., Tokyo, Japan

[21] Appl. No.: 531,511

[22] Filed: Sep. 12, 1983

[30] Foreign Application Priority Data

Sep. 20, 1982 [JP] Japan ..... 57-164691
Dec. 23, 1982 [JP] Japan ..... 57-194041[U]

[51] Int. Cl.[3] ..... G03G 15/08

[52] U.S. Cl. ..... 355/15; 118/652; 430/125

[58] Field of Search ..... 355/15, 3 DD, 14 D; 118/652; 430/125

[56] References Cited

U.S. PATENT DOCUMENTS 4,101,215 7/1978 Fottner et al. ..... 355/15
4,266,328 5/1981 Harada et al. ..... 355/3 DD X
4,402,103 9/1983 Yanagawa et al. ..... 355/15 X
4,423,950 1/1984 Sagami ..... 355/15

*Primary Examiner*—A. C. Prescott
*Attorney, Agent, or Firm*—David G. Alexander

[57] ABSTRACT

A cleaning apparatus is disclosed which removes residual toner particles from a photoconductor by use of magnetic carrier particles. The carrier particles form magnetic brushes which adsorb and thereby remove the residual toner particles from the photoconductor. Two relay sleeves each having permanent magnets therein-side cause the removed toner particles to circulate together with the carrier particles. A toner collector roller and a counter electrode face each other at opposite sides of a circulation path for the carrier particles which are carrying the toner particles therewith. The toner collector roller collects the toner particles adsorbed by the carrier particles. The counter electrode comprises a relatively narrow and grounded conductive electrode portion and a relatively wide insulator portion.

10 Claims, 3 Drawing Figures

PHOTOCONDUCTOR CLEANING APPARATUS

BACKGROUND OF THE INVENTION

The present invention relates to a cleaning apparatus for a photoconductor which is installed in an electrophotographic copier or the like and, more particularly, to a cleaning apparatus which efficiently removes and collects residual toner particles from a photoconductor by using magnetic brushes which are formed by magnetic carrier particles.

In an electrophotographic copier of the type which develops a latent image electrostatically formed on a photoconductor, or a recording medium, part of the toner usually remains on the photoconductor surface even after the toner image has been transferred to a sheet. To remove the residual toner particles and thereby clean the photoconductor surface, the copier is furnished with a cleaning apparatus which includes a magnetic brush device for forming magnetic brushes and removing the toner particles thereby, and a toner collector device for collecting the removed toner particles. A prior art magnetic brush device comprises a non-magnetic sleeve which has permanent magnets thereinside for holding magnetic brushes and is supplied with a voltage of a polarity opposite to that of the toner particles in order to adsorb the toner particles. Meanwhile, a prior art toner collector device comprises a toner collector sleeve supplied with a voltage higher than the voltage applied to the non-magnetic sleeve, thereby adsorbing the toner particles out of the magnetic brushes in the magnetic brush device. The toner particles deposited on the toner collector sleeve are usually scraped off the sleeve by a blade or the like which is held in pressing contact with the periphery of the sleeve, a suitable receptacle being employed for collecting the shaved toner particles.

A problem encountered with such a prior art cleaning apparatus is that the toner particles adsorbed by the brushes on the non-magnetic sleeve cannot be shifted to or efficiently adsorbed by the toner collector sleeve unless a voltage higher than the voltage applied to the non-magnetic sleeve is applied to the toner collector sleeve. The extremely high voltage thus applied to the toner collector sleeve is disadvantageous because it allows the voltage to leak from the toner collector sleeve to the non-magnetic sleeve across the magnetic brushes formed by the magnetic carrier particles, the leak greatly effecting the operation for toner collection.

SUMMARY OF THE INVENTION

It is therefore an object of the present invention to provide a photoconductor cleaning apparatus which efficiently collects toner particles remaining untransferred on a photoconductor.

It is another object of the present invention to provide a photoconductor cleaning apparatus which prevents leak of a voltages applied to a magnetic brush device or to a toner collector device, which tends to occur across magnetic carrier particles.

It is another object of the present invention to provide a photoconductor cleaning apparatus which reduces the fatigue of a magnetic carrier.

It is another object of the present invention to provide a generally improved photoconductor cleaning apparatus.

A cleaning apparautus for removing and collecting untransferred residual toner particles from a photoconductor by means of magnetic brushes which are formed by magnetic carrier particles of the present invention comprises magnetic brush means for removing the residual toner particles from the photoconductor by causing the residual toner particles to be adsorbed by the magnetic carrier particles which are charged to a polarity opposite to a charge polarity of the residual toner particles, toner collector means for collecting the residual toner particles adsorbed by the magnetic carrier particles in the magnetic brush means out of the magnetic carrier particles, and circulation means for the magnetic carrier particles which extends between the magnetic brush means and the toner collector means.

In accordance with the present invention, a cleaning apparatus is disclosed which removes residual toner particles from a photoconductor by use of magnetic carrier particles. The carrier particles form magnetic brushes which adsorb and thereby remove the residual toner particles from the photoconductor. Two relay sleeves each having permanent magnets thereinside cause the removed toner particles to circulate together with the carrier particles. A toner collector roller and a counter electrode face each other at opposite sides of a circulation path for the carrier particles which are carrying the toner particles therewith. The toner collector roller collects the toner particles adsorbed by the carrier particles. The counter electrode comprises a relatively narrow and grounded conductive electrode portion and a relatively wide insulator portion.

The above and other objects, features and advantages of the present invention will become apparent from the following detailed description taken with the accompanying drawings.

DESCRIPTION OF THE PREFERRED EMBODIMENT

While the photoconductor cleaning apparatus of the present invention is susceptible of numerous physical embodiments, depending upon the environment and requirements of use, a substantial number of the herein shown and described embodiment have been made, tested and used, and all have performed in an eminently satisfactory manner.

Figure 1:
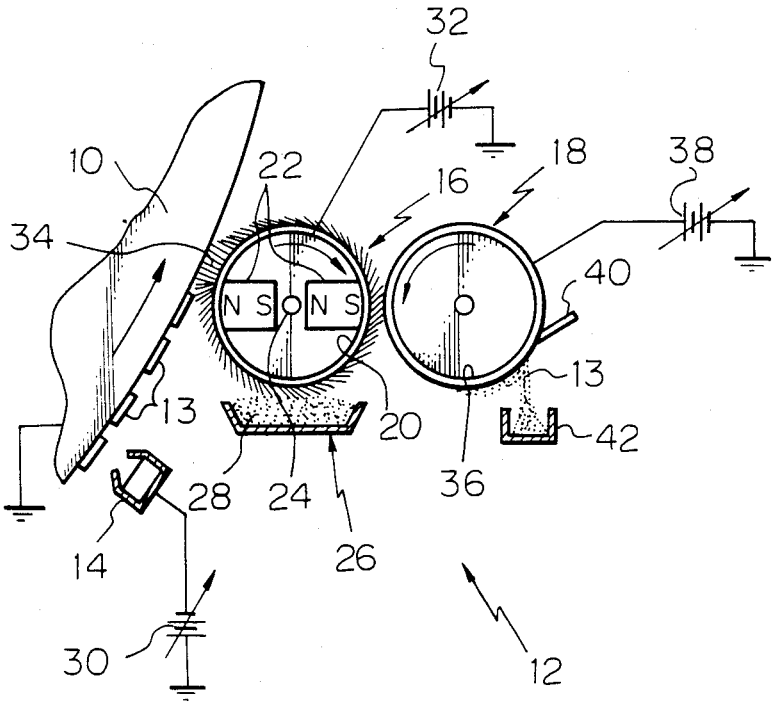
Fig. 1 PRIOR ART
FIG. 1 is a schematic elevation of a prior art magnetic brush type cleaning apparatus.

To facilitate understanding of the present invention, a brief reference will be made to a prior art cleaning apparatus, depicted in FIG. 1. A photoconductor drum 10, which serves as a recording medium, is rotated in a direction indicated by an arrow by a drive mechanism (not shown). A cleaning apparatus 12 is located in the vicinity of the periphery of the drum 10 and downstream of a transfer station (not shown) with respect to the direction of rotation of the drum 10. The apparatus 12 generally comprises a corona charger 14, a magnetic brush device 16, and a toner collecting device 18. The corona charger 14 is adapted to deposite a charge on the surface of the drum 10 in order to uniformalize the polarity of toner particles 13 reamining on the drum surface.

The magnetic brush device 16 is made up of a non-magnetic sleeve 20 for holding magnetic brushes thereon, and permanent magnets 22 installed in the sleeve 20. While the sleeve 20 is rotatable about a shaft 24 as indicated by an arrow in the drawing, the permanent magnets 22 are held stationary in the illustrated positions. A tray 26 stores therein a mass of magnetic carrier particles 28 which are common to carrier particles used for two-component development. The carrier 28 is attracted by the magnets 22 to be adsorbed by the sleeve 20 and then carried by the sleeve 20 toward the drum.

The corona charger 14 is supplied by a power source 30 the polarity of which is selected such that it discharges with a same polarity as a charge deposited on the residual toner particles 13. The sleeve 20 is supplied by a power source 32 with a voltage whose polarity is opposite to that of the charge on the toner particles 13. Carrier particles 34 on the sleeve 20 stand upright in the form of hairs in the vicinity of the magnetic poles of the magnets 22, thereby forming magnetic brushes. The sleeve 20 in rotation causes the carrier or magnetic brushes to brush against the toner particles 13 on the photoconductor drum 10. The voltage applied to the sleeve 20 induces a static attraction which causes the toner particles 13 to be adsorbed by the carrier particles 34. This removes the toner particles 13 from the drum 10 to clean the drum surface.

In response to further movement of the sleeve 20, the carrier 34 entraining the toner 13 forms upright hairs again in the position 180° remote from the position where it caught the toner. The toner collector 18 is located in this 180° remote position and comprises a toner collector sleeve 36, which is rotatable in a direction indicated by an arrow. The sleeve 36 is supplied by a power source 38 with a voltage common in polarity to the voltage applied to the sleeve 20. Because the voltage applied to the sleeve 36 is generally two times the voltage applied to the sleeve 20, it allows the sleeve 36 to take the toner 13 from the carrier 34 which is engaged with the sleeve 36. As soon as the toner 13 on the sleeve 36 reaches a position where a blade 40 is pressed against the sleeve 36, it is shaved by the blade 40 off the sleeve 36 and collected in a receptacle 42.

In the prior art cleaning apparatus 12, it is usually required to impress a voltage ranging from 200 V to 1,000 V to the sleeve 20 which is adapted to hold magnetic brushes thereon. Therefore, a voltage as high as 1,000–2,000 V has to be applied to the toner collector sleeve 36 in order to develop a potential difference between the sleeves 20 and 36. Application of such a high voltage, however, tends to cause leak between the sleeves 36 and 20 across the intervening carrier to thereby detriment smooth toner collection.

Figure 2:
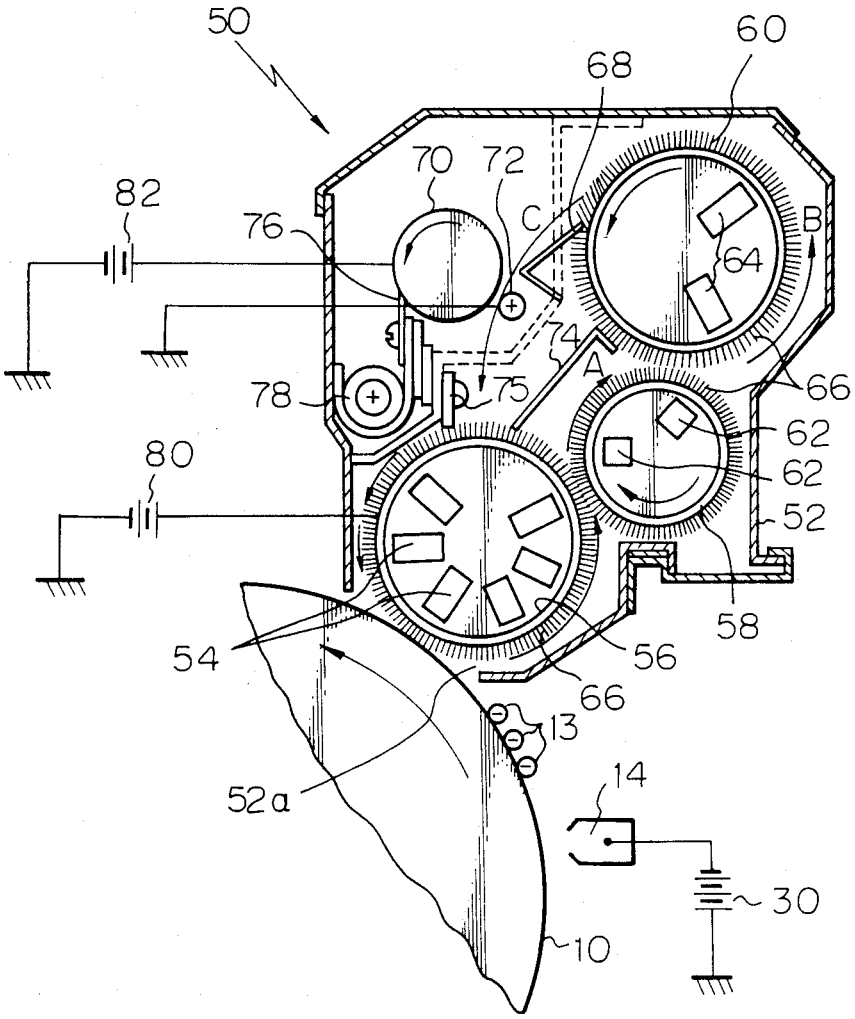
FIG. 2 is an elevation of a magnetic brush type cleaning apparatus embodying the present invention.

Referring to FIG. 2, a cleaning apparatus embodying the present invention is shown and generally designated by the reference numeral 50. The present invention contemplates to overcome the problem discussed above by defining a substantial spacing between the magnetic brush device and the toner collector device, so that the carrier will be circulated therebetween.

In FIG. 2, a photoconductor drum 10 rotates as indicated by an arrow carrying residual toner particles 13 therewith which have been charged by a corona charger 14 to the negative polarity, for example. The cleaning apparatus 50 comprises a casing 52 having an opening 52*a* in which a magnetic brush device comprising a non-magnetic metal sleeve 56 is disposed. The sleeve 56 has thereinside stationary permanent magnets 54 and rotates counterclockwise relative to the magnets 54. Disposed above the sleeve 56 are two relay sleeves 58 and 60 both of which are made of a non-magnetic material. The relay sleeves 58 and 60, like the sleeve 56, respectively have permanent magnets 62 and 64 fixed in place thereinside.

The relay sleeve 58 faces the sleeve 56 from an upward and rightward position as viewed in FIG. 2 and rotates clockwise as opposed to the sleeve 56. The relay sleeve 60 faces the relay sleeve 58 from above and rotates counterclockwise. The sleeves 56, 58 and 60 individually rotate while attracting magnetic carrier particles 66 thereto, so that contiguous circulation paths for the carrier 66 are defined as indicated by arrows A and B. These sleeves will operate in the same manner as a draw-up sleeve installed in an ordinary apparatus for magnetic brush development.

A scraper 68 acts on the periphery of the relay sleeve 60 in order to scrape the carrier off the sleeve surface. The carrier removed from the sleeve 60 by the scraper 68 moves along a third circulation path C defined by the scraper 68, a toner collector roller 70 and a counter electrode 72, which will be described. The carrier drops onto an upper portion of the sleeve 56 to become deposited between the sleeve 56 and a second scraper 74. Then, the carrier is adsorbed by the periphery of the sleeve 56 to a thickness determined by a doctor blade 75, sweeps the surface of the drum 10, and again circulates through the contiguous paths A, B and C.

In the circulation path C, the carrier drops through the gap between the collector roller 70 and the counter electrode 72. The roller 70 is rotatable in a direction indicated by an arrow. A blade 76 is held in pressing contact with the roller 70. Located below the blade 76 is a device 78 for discharging the collected toner.

A power source 80 is connected to the sleeve 56 to impress it a voltage of 200–500 V whose polarity is opposite to that of the toner, e.g. positive. A second power source 82 is connected to the collector roller 70 to supply it with a voltage which is the same in polarity and level as the voltage applied to the sleeve 56. The counter electrode 72 is connected to ground. Therefore, an electric field with an inensity of about 1,000–5,000 V/cm is developed between the collector roller 70 and the counter electrode 72.

In operation, the corona charger 14 is energized before cleaning the drum 10 in order to dissipate the charge on the drum. This neutralizes an electrostatic latent image on the drum 10 and, at the same time, increases and uniformalizes the negative charge on the toner 13. As the magnetic brushes formed by the carrier 66 on the sleeve 56 sweep the periphery of the drum 10, the negatively charged toner 13 is adsorbed by the carrier 66 due to the attraction exerted by the positive voltage supplied to the sleeve 56. The carrier 66 is sequentially conveyed by the relay sleeves 58 and 60 along the circulation paths A and B and then along the circulation path C to drop toward the sleeve 56. While this part of the carrier flows through the gap between the roller 70 and the electrode 72, it is influenced by the electric field existing there. The electric field removes the negatively charged toner from the carrier and causes it to adhere to the collector roller 70. The toner on this roller 70 is scraped off by the blade 76 due to the rotation of the roller 70 and thereby collected in the toner discharging device 78. The carrier released the toner drops onto the sleeve 56 to move along the circulation paths again. It will be noted that the corona charger 14 is not essential and may be omitted, if desired.

Figure 3:
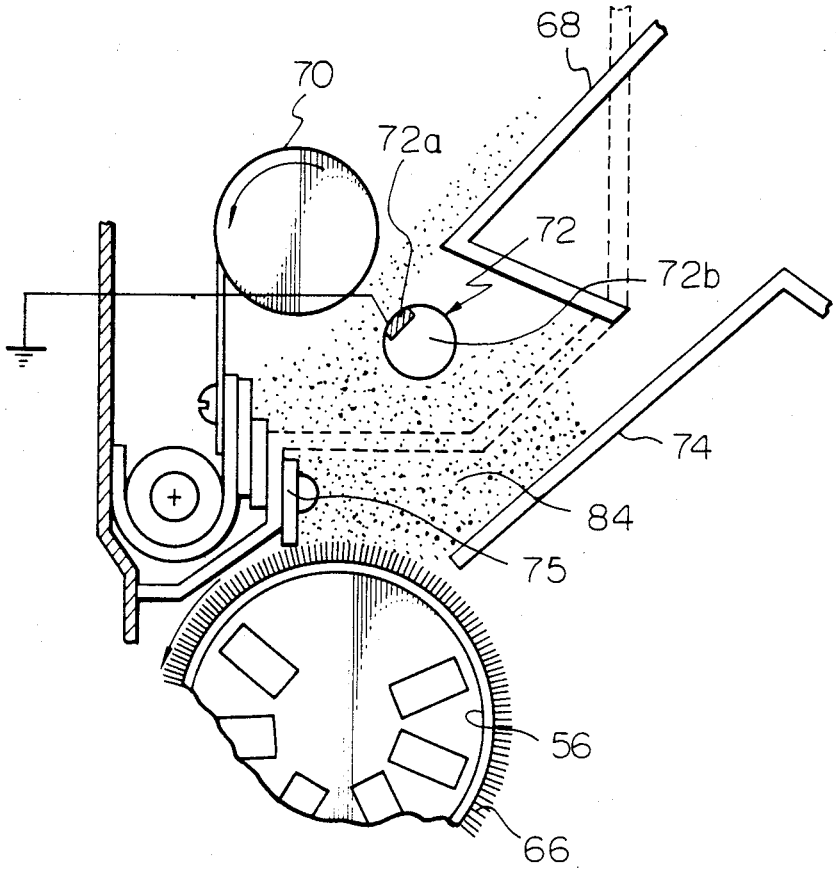
FIG. 3 is a view of a practical example of a counter electrode installed in the apparatus shown in FIG. 2.

Referring to FIG. 3, a practical example of the counter electrode 72 included in the cleaning apparatus is shown. The counter electrode 72 comprises an electrode portion 72*a* made of a conductive material and provided with a relatively small area, and an insulator portion 72*b* having a relatively large area. The electrode portion 72*a* is connected to ground and located to face the toner collector roller 70. A large quantity of carrier flows through the gap between the collector roller 70 and the counter electrode 72 to become deposited between the doctor blade 75 and the scraper 74, as indicated by the reference numeral 84. Even if the carrier 84 contacts the counter electrode 72 in the course of such downward flow, major part of the contact will occur at the larger insulator portion 72*b* and the other negligible part at the smaller electrode portion 72*a*. This prevents the voltage applied to the collector roller 70 from leaking across the carrier 84 to the counter electrode 72, thereby remarkably improving the toner collection efficiency.

In summary, it will be seen that the present invention provides a cleaning apparatus for a photoconductor which permits electrically independent arrangement of a sleeve for holding magnetic brushes and a roller for toner collection, thereby eliminating the need for the application of voltage to the sleeve and roller in the conventional relationship in level. This precludes the problem of leak and facilitates insulation. Additionally, the apparatus of the present invention has a longer carrier circulation path than conventional and thereby allows a larger amount of carrier to be present within the path, resulting in a decrease in the fatigue rate of the carrier.

Various modifications will become possible for those skilled in the art after receiving the teachings of the present disclosure without departing from the scope thereof.

What is claimed is:

1. A cleaning apparatus for removing and collecting untransferred residual toner particles from a photoconductor by means of magnetic brushes which are formed by magnetic carrier particles, said apparatus comprising:

magnetic brush means for removing the residual toner particles from the photoconductor by causing the residual toner particles to be adsorbed by the magnetic carrier particles which are charged to a polarity opposite to a charge polarity of the residual toner particles;

toner collector means for collecting the residual toner particles adsorbed by the magnetic carrier particles in said magnetic brush means out of said magnetic carrier particles; and circulation means for the magnetic carrier particles which extends between the magnetic brush means and the toner collector means.

2. The apparatus as claimed in claim 1, in which the toner collector means comprises a toner collector roller supplied with a voltage opposite in polarity to the charge on the residual toner particles, and a counter electrode facing said toner collector roller and connected to ground.

3. The apparatus as claimed in claim 2, in which the toner collector roller and the counter electrode in the toner collector means are arranged such that the magnetic carrier particles circulated by the circulation means and containing the residual toner particles move through between the toner collector roller and the counter electrode.

4. The apparatus as claimed in claim 2, in which the toner collector means further comprises a blade for removing the toner particles from the toner collector roller, and toner discharging means for discharging the toner particles removed from the toner collector roller.

5. The apparatus as claimed in claim 2, in which the counter electrode comprises a conductive electrode portion having a relatively small area and connected to ground, and an insulator portion having a relatively large area, said conductive electrode portion facing the toner collector roller.

6. The apparatus as claimed in claim 1, in which the circulation means comprises at least one relay sleeve interposed between the magnetic brush means and the toner collector means, said relay sleeve having permanent magnets thereinside.

7. The apparatus as claimed in claim 6, in which the circulation means further comprises a scraper for scraping the magnetic carrier particles off the relay sleeve and feeding the scraped magnetic carrier particles to the toner collector means.

8. The apparatus as claimed in claim 1, in which the circulation means comprises two relay sleeves each having permanent magnets thereinside.

9. The apparatus as claimed in claim 1, in which the magnetic brush means comprises a magnetic brush forming sleeve which faces the photoconductor and has permanent magnets thereinside, said magnetic brush forming sleeve being supplied with a voltage the polarity of which is opposite to a charge polarity of the residual toner particles.

10. The apparatus as claimed in claim 1, further comprising a corona charger for effecting corona charge to uniformalize the polarity of the unstable toner particles which remain on the photoconductor after the transfer of a toner image to a recording medium.

* * * * *